US007469911B2

(12) United States Patent
Sanders

(10) Patent No.: US 7,469,911 B2
(45) Date of Patent: Dec. 30, 2008

(54) BINDING SYSTEM

(76) Inventor: Martin Sanders, 3 Toptree Way, Thrybergh, Rotherham, S65 4ER (GB)

( * ) Notice: Subject to any disclaimer, the term of this patent is extended or adjusted under 35 U.S.C. 154(b) by 78 days.

(21) Appl. No.: 10/475,658

(22) PCT Filed: Apr. 22, 2002

(86) PCT No.: PCT/GB02/01851

§ 371 (c)(1),
(2), (4) Date: Mar. 31, 2004

(87) PCT Pub. No.: WO02/085474

PCT Pub. Date: Oct. 31, 2002

(65) Prior Publication Data

US 2004/0155433 A1 Aug. 12, 2004

(30) Foreign Application Priority Data

Apr. 24, 2001 (GB) ..... 0109957.1

(51) Int. Cl.
*A63C 9/00* (2006.01)
*A63C 9/20* (2006.01)

(52) U.S. Cl. ..... 280/14.24; 280/613; 280/623; 280/632; 280/634; 280/14.22

(58) Field of Classification Search ..... 280/11.3, 280/11.31, 611, 613, 616–620, 622–625, 280/634, 14.22, 14.23
See application file for complete search history.

(56) References Cited

U.S. PATENT DOCUMENTS 3,560,011 A * 2/1971 Spademan ..... 280/624
3,897,075 A * 7/1975 Cutter ..... 280/626
4,113,275 A * 9/1978 Sherwin ..... 280/615
4,270,770 A * 6/1981 Spademan ..... 280/624
4,395,055 A * 7/1983 Spademan ..... 280/624
4,403,789 A * 9/1983 Hickey ..... 280/614
4,418,937 A 12/1983 Salomon
4,542,599 A * 9/1985 Annovi ..... 36/117.4
5,577,757 A * 11/1996 Riepl et al. ..... 280/624
5,901,971 A 5/1999 Eaton
6,145,868 A * 11/2000 Schaller et al. ..... 280/624
6,213,493 B1 4/2001 Korman
6,270,109 B1 * 8/2001 Turner et al. ..... 280/613
6,457,736 B1 * 10/2002 Maravetz et al. ..... 280/624
6,492,387 B2 * 12/2002 Carson et al. ..... 514/307
6,536,795 B2 * 3/2003 Okajima et al. ..... 280/613
6,648,365 B1 * 11/2003 Laughlin et al. ..... 280/624
6,705,634 B2 * 3/2004 Anderson et al. ..... 280/627
6,726,238 B2 * 4/2004 Poscich ..... 280/624
6,733,031 B2 * 5/2004 Okajima et al. ..... 280/613
6,739,615 B1 * 5/2004 Maravetz et al. ..... 280/624
6,742,800 B2 * 6/2004 Okajima ..... 280/613
6,863,285 B2 * 3/2005 Gonthier ..... 280/14.22

* cited by examiner

*Primary Examiner*—Christopher Ellis
*Assistant Examiner*—Vaughn T Coolman
(74) *Attorney, Agent, or Firm*—Venable LLP; Michael A. Sartori; Steven J. Schwarz

(57) ABSTRACT

The invention provides a binding system for a snowboard comprising a boot (2) and a boot receiving plate (4), the boot receiving plate (4) having at least one engagement element (6), and the boot (2) having at least one boot gripping element (3) wherein the or each boot gripping element (3) and the or each engagement element are operable for flexible respective co-engagement.

21 Claims, 14 Drawing Sheets

2.
29.
3.
26.
6.
9.
28.
8.
4.
5.

31.
52
38.
32.
33.
34.
35a.
35.
36.
39.
39a.
90.
4.

BINDING SYSTEM

The present invention relates to a binding system and, particularly, although not exclusively, relates to a binding system for use on a snowboard, downhill ski or cross-country ski.

Snowboarding is a sport that has become extremely popular around the world. The sport itself involves fixing one's feet to a board in a manner whereby the snowboarder (referred to as the "rider") stands on the snowboard. In doing this, the rider is able to control the board as he/she travels down a slope.

When secured to the board, the rider can perform many dynamic and forceful manoeuvres. This places a demand on snowboard bindings to fulfil many criteria. Safety in these conditions is very important and it is a common feature of most existing snowboard bindings for them not to self-release. It is only the rider, and not any other external factors such as shocks or bumps, which should initiate the release of the binding when snowboarding. This is a fundamental requirement that still remains. The issue of control then becomes a factor for consideration. When turning or performing a manoeuvre, the rider uses the edges and speed of the snowboard to generate the required forces. To gain this edge control through the snowboard, the rider must apply dynamic pressure to toe-side and heel-side edges. Therefore, it follows that there must be secure support for the forward and reverse rotation of the rider's feet on the board. These basic factors constitute the aim of the snowboard binding.

There are many designs for snowboard bindings on the market. However, the most common is the strap and buckle binding. This binding is normally for soft snowboard boots and works by securing the boot to the binding by means of an arrangement of straps and buckles. These bindings also generally have a heel and ankle-supporting structure referred to as a 'highback'. This highback creates a stable structure through which forces can be transmitted when performing heel edge turns.

Such bindings are generally referred to as 'manual bindings'. Manual bindings have certain drawbacks for the user. One such drawback is the inconvenience involved in the repetitive action of strapping in and releasing the boot from the binding. Such a procedure can be quite tiresome and very time consuming. The time spent strapping and releasing can constitute a large part of a typical snowboarding session. The action of having to constantly bend over to adjust and secure these bindings often by gloved hands can also create complications due to reduced dexterity. The binding and release procedure also puts the rider into an awkward and unstable position particularly when on an inclined slope. This normally results in the rider resorting to sitting on the cold snow while adjusting and tending to their strap bindings.

To overcome these problems a range of step-in bindings have been devised which use a variety of mechanisms and assemblies to secure the boot to the binding. The basic approach of a step-in binding, unlike the manual binding, is one that does not require engaging or activation by hand. The area of step-in bindings has grown as manufactures realise the importance of a quick and easy method of engaging the soft-boot to the snowboard. However, the present step-in bindings have drawbacks created by the environment and the way they are used or operated. The problem of snow clogging up mechanisms and assemblies inhibits the engagement and securing of both manual and step-in bindings. Snow clogged step-in bindings must be cleared before engaging can take place. Step-in binding mechanisms that are subject to many outside forces from jumps, shocks and manoeuvres can often accidentally release. These factors create problems for safety and convenience, requiring extra time and effort that the step-in binding should be aiming to reduce.

It is one aim of the embodiments of the present invention to address the above problems and to provide a step-in binding system that allows for snow to be present and not restrict the engagement or reduce the safety of the snowboard binding. It is a further aim of the invention to provide a simple and convenient engaging and release system of the snowboard binding. It is yet a further aim of the invention to provide a means of securing the engaged position against accidental release caused by outside forces. It is a further aim of the invention to provide adequate stability and support to the rider's foot/boot while snowboarding and provide superior control over both toe-side and heel-side turns. It is yet a further aim of the invention to allow easy entry and exit for the rider's engaging boot.

According to a first aspect of the present invention, there is provided a binding system for a snowboard comprising a boot and a boot receiving plate, the boot receiving plate having at least one engagement element, and the boot having at least one boot gripping element wherein the or each boot gripping element and the or each engagement element are operable for flexible respective co-engagement.

The boot receiving plate may be secured to a snowboard, downhill ski or cross-country ski or other device where boot fixing is an important requirement. Preferably, the binding system is a stepping binder system.

Preferably, the binding system comprises first and second boot gripping elements and, preferably, first and second engagements elements. Preferably, the first and second boot gripping elements are both provided on the boot. Preferably, the first and second engagements elements are provided on the boot receiving plate.

The boot may comprise heel and toe sections. Preferably, the first and second boot gripping elements are located on either side of the boot, preferably, on either side of the heel of the boot. Preferably, the first and second engagement means are located in corresponding positions on the boot plate to the first and second boot gripping elements.

Preferably, the binding system comprises means for securing the toe section of the boot to the boot receiving plate. Preferably, the toe section comprises a cavity extending therethrough. Preferably, a bar extends substantially across said cavity. Preferably, the boot receiving plate comprises hooking means extending substantially upwardly therefrom, which hooking means may hook around said bar thereby securing the toe section of the boot to the boot receiving plate.

Preferably, the first boot gripping element and the first engagement element are mutually arranged to provide at least two binding gripping positions at different boot heights above the boot plate.

More preferably, the second boot gripping element and the second engagement element are mutually arranged to provide at least two binding gripping positions at different boot heights above the boot receiving plate.

Advantageously, provision of at least two binding gripping positions at different boot heights above the boot receiving plate at two locations across the boot improves the stability and support of the rider's foot/boot while snowboarding. As obstructions such as snow become located between the boot receiving plate and the sole of the boot, the first and second boot gripping and engagement elements may still secure the boot to the snowboard at a first height above the boot receiving plate. As the obstructions become dislodged, the boot may automatically progress further down towards the boot receiving plate and maintain a secure position at a second, lower height above the boot receiving plate.

Preferably, the means for providing at least two binding gripping positions above the boot receiving plate comprises ratchet means operable to provide the binding between the respective boot gripping element and the engaging element.

Preferably, the ratchet means comprise three or more binding positions at different boot heights above the boot receiving plate.

Preferably, the ratchet means comprise an engagement member and a rack, the rack comprising a plurality of teeth with spaces therebetween, each space providing an engagement member receiving position. Preferably, the rack engages with the engagement member at a plurality of boot heights above the boot plate to optionally secure the boot at one of the said plurality of boot heights.

Preferably, the rack and engagement member are designed so that their respective surfaces are operable to slide over each other in a first direction and operable to lock in a direction opposite to the first direction.

Preferably, the tooth receiving positions provided by the rack and the engagement member are operable to slide over each other as the boot is urged towards the boot receiving plate. Preferably, and advantageously, a plurality of optional gripping positions are thereby provided to lock the boot above the boot receiving plate thereby preventing the boot from being urged away from the boot receiving plate.

Preferably, the outer surface of the boot gripping element comprises the rack which is, preferably, attached to or is integral with the boot. Preferably, the engagement member, which may be an engagement bar, is attached to or is integral with the boot receiving plate.

Preferably, the rack extends away from the boot substantially towards and perpendicular to the boot receiving plate. Preferably, the teeth of the rack extend substantially parallel with the boot receiving plate and, preferably, away from the boot.

Preferably, the teeth of the rack are arranged to engage with the engagement member.

Preferably, the engagement element comprises the engagement member which is, preferably, supported substantially parallel with the boot receiving plate in between two supports, which supports extend substantially away from and perpendicular to the boot receiving plate. Preferably, the engagement bar extends substantially inwardly from the supports and, preferably, generally in a direction towards the rack.

The or each engagement element may be flexible. Alternatively, or additionally, the or each boot gripping element may be flexible. However, preferably, the or each boot gripping element is flexible and the or each engagement element is substantially rigid. However, combinations of the preferred embodiment may be possible. For example, the first boot gripping element may be flexible and the first engagement element may be rigid, and the second boot gripping element may be rigid and the second engagement element may be flexible.

Preferably, the outer surface of the boot gripping element comprise the rack. The rack preferably comprises a rigid material which is, preferably, secured to the underside of the boot by suitable means. Preferably, the boot gripping element further comprises a cavity which is, preferably, located substantially behind the rack. Preferably, said cavity provides said flexibility.

The cavity may be substantially empty. Preferably, the cavity contains a flexible, elastomeric material, which is compressed by the rack upon engagement and/or disengagement from the engagement element. Advantageously, the rack may flex substantially into the cavity upon engagement and/or disengagement from the engagement element. Advantageously, as the rack flexes, the elastomeric material in the cavity is compressed to allow the engagement/disengagement of the binding system. Advantageously, the elastomeric material prevents the cavity from becoming filled with unwanted foreign material which would prevent flexing of the boot gripping element.

Preferably, the binding system comprises at least one binding release mechanism.

Preferably, the or each engagement element each comprises a binding release mechanism operable to disengage the binding system as required. Preferably, the release mechanism is operable to disengage the engagement bar from the rack. Preferably, the binding release mechanism comprises a levering member which is, preferably, pivotally linked to the engagement element. Preferably, the levering member is a lever which is, preferably, operable to engage the boot gripping element when this is flexible, or the engagement element when this is flexible.

In a preferred embodiment, the boot gripping element is flexible and, therefore, the levering member engages said flexible boot gripping element. Preferably, the levering member is pivotally supported adjacent the engagement bar and the application of downward pressure from a user to a first end of the lever causes pivotal rotation such that the second end of the levering member engages the boot gripping element. Advantageously, as the levering member engages the boot gripping element, said element flexes thereby disengaging the boot gripping element from the engagement element.

Advantageously, the application of downward pressure onto the lever serves the dual purpose of disengaging the engagement bar from the ratchet rack and simultaneously urging the boot upwardly and out of the snowboard binding.

In a preferred embodiment, the binding release mechanism may be substantially spaced apart from the binding system such that it may be remote activated. Preferably, the remote binding release mechanism is operable to release the engagement of the or each engagement element from the or each boot gripping element, preferably, simultaneously. Preferably, where a spaced apart binding release mechanism is used, the engagement element comprises an engagement member which is substantially rigid such that it engages the boot gripping element under normal condition and yet, preferably, sufficiently resilient such that it is operable to be disengaged from the boot gripping element upon the application of a disengagement force from the user.

Preferably, the release mechanism comprises pulling means which, more preferably, comprise, a cable which, preferably, comprises first and second ends. Preferably, the disengagement force may be applied to the engagement element via the cable. Preferably, the first end of the cable is secured to the rear of the engagement element such that application of the force to the second end pulls the engagement bar out of engagement from the rack. Alternatively, or additionally, the first end of the cable may be attached to the boot gripping element such that application of the force to the second end pulls the rack out of engagement from the engagement bar.

Preferably, the engagement element comprises a flange which extends away from the engagement bar, the flange having a slot extending preferably substantially perpendicular to the engagement member. Preferably, the first end of the cable comprises a rigid rod, which rod passes through said slot in the flange.

Preferably, the second end of the cable is located on the boot, preferably, at a position substantially higher up the boot than the binding system. More specifically, the release mechanism is located higher up the boot than the ratchet. Preferably, the cable is substantially contained within the boot.

Preferably, the binding release mechanism is located at the back of the boot. Preferably, the binding release mechanism is located above the ankle. Preferably, the second end of the cable comprises handle means. Preferably, means are provided at the back of the boot by which the handle may be maintained at different heights at the back of the boot. Preferably, said means comprise a plurality of hooking means arranged vertically spaced apart up the back of the boot on which the handle may be secured.

Preferably, the boot further comprises means to adjust the lean of the boot. Preferably, said adjustment means comprises an upper heel section and a lower heel section, the relative positioning of said upper and lower heel sections being adjustable, preferably, about a hinge. Preferably, adjustment is operable via a ratchet, which ratchet being, preferably, adjustable substantially about the plane substantially perpendicular to the boot receiving plate to thereby allow the relative positioning of the upper and lower heel sections and, hence, lean of the boot to be altered about the hinge.

Preferably, the ratchet comprises first and second racks each having complimentary surfaces. Preferably, the first rack is provided on the back of the upper heel section and, preferably, comprises a threaded shank extending outwardly therefrom. Preferably, the second rack has an elongate slot extending therethrough, which slot may accommodate said shank. Preferably, the second rack is operable to be secured to the first rack at a plurality of communicating locations by passing the shank through the slot. Preferably, the lower region of the second shank comprises hooking means, which hooking means engages a corresponding sloped hooking means at the upper region of the low heel section.

According to a second aspect of the present invention, there is provided a method of binding a boot to a boot receiving plate, the method comprising the steps of:—

(i) providing a binding system according to the first aspect;

(ii) locating the boot such that the or each boot gripping element is engaged by the or each corresponding engaging element; and (iii) pressing the boot down toward the boot receiving plate until the or each boot engaging element locks in position with the or each boot gripping element, wherein multiple locking positions are provided during the said downward movement at different heights above the boot receiving plate.

According to a third aspect of the present invention, there is provided a method of releasing a boot from a boot receiving plate, the method comprising the steps of:—

(i) providing a binding system according to the first aspect wherein the system further comprises a remote release mechanism, said mechanism comprising pulling means attached to the or each engagement element; and (ii) pulling on the pulling means such that the or each engagement element is disengaged from the boot gripping element to thereby allow the boot to be removed from the binding system.

All of the features described herein may be combined with any of the above aspects, in any combination:—

For a better understanding of the invention, and to show how embodiments of the same may be carried into effect, reference will be made, by way of example, to the accompanying diagrammatic drawings, in which:—

Figure 4A:
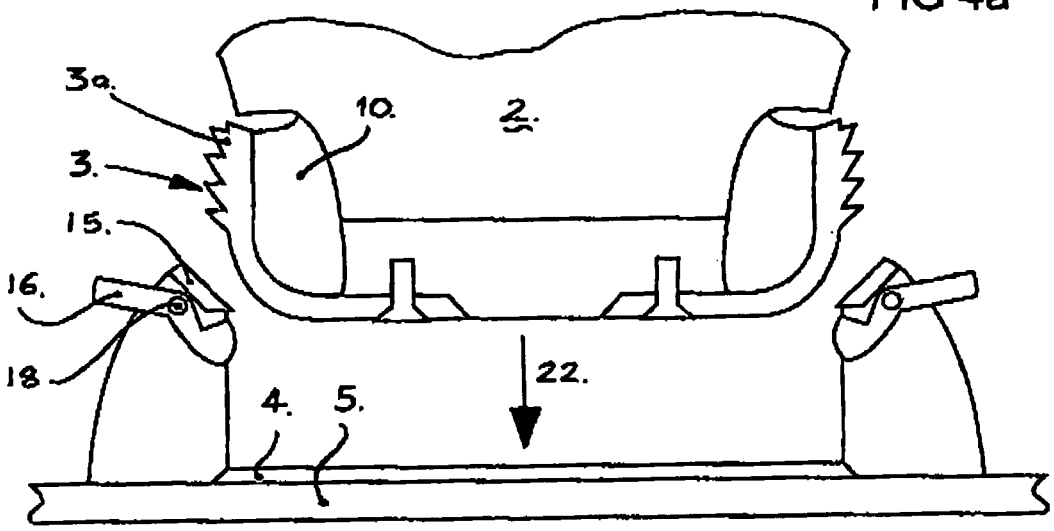
Figure 4B:
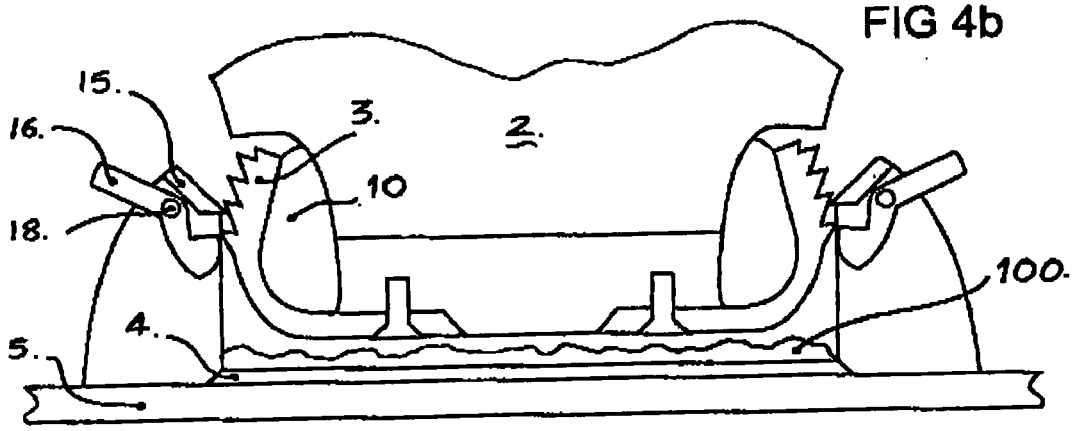
Figure 4C:
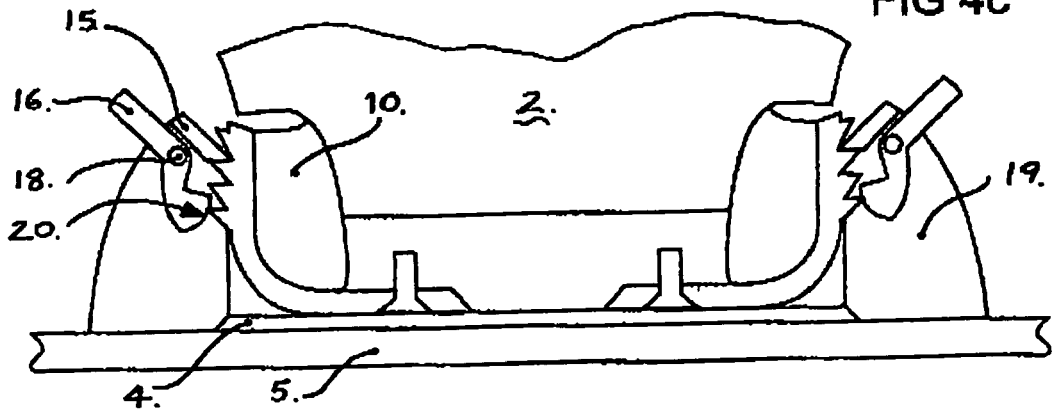
Figure 5:
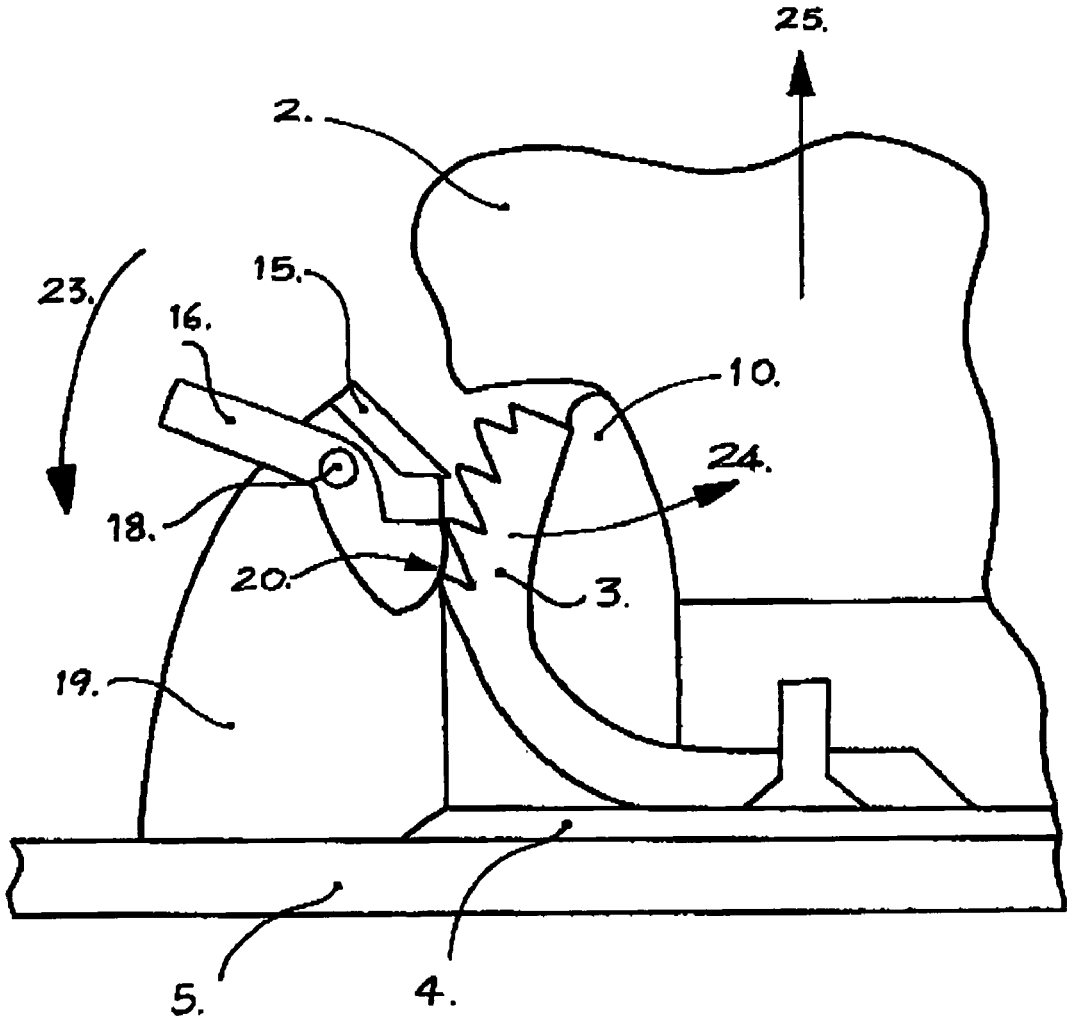
Figure 6:
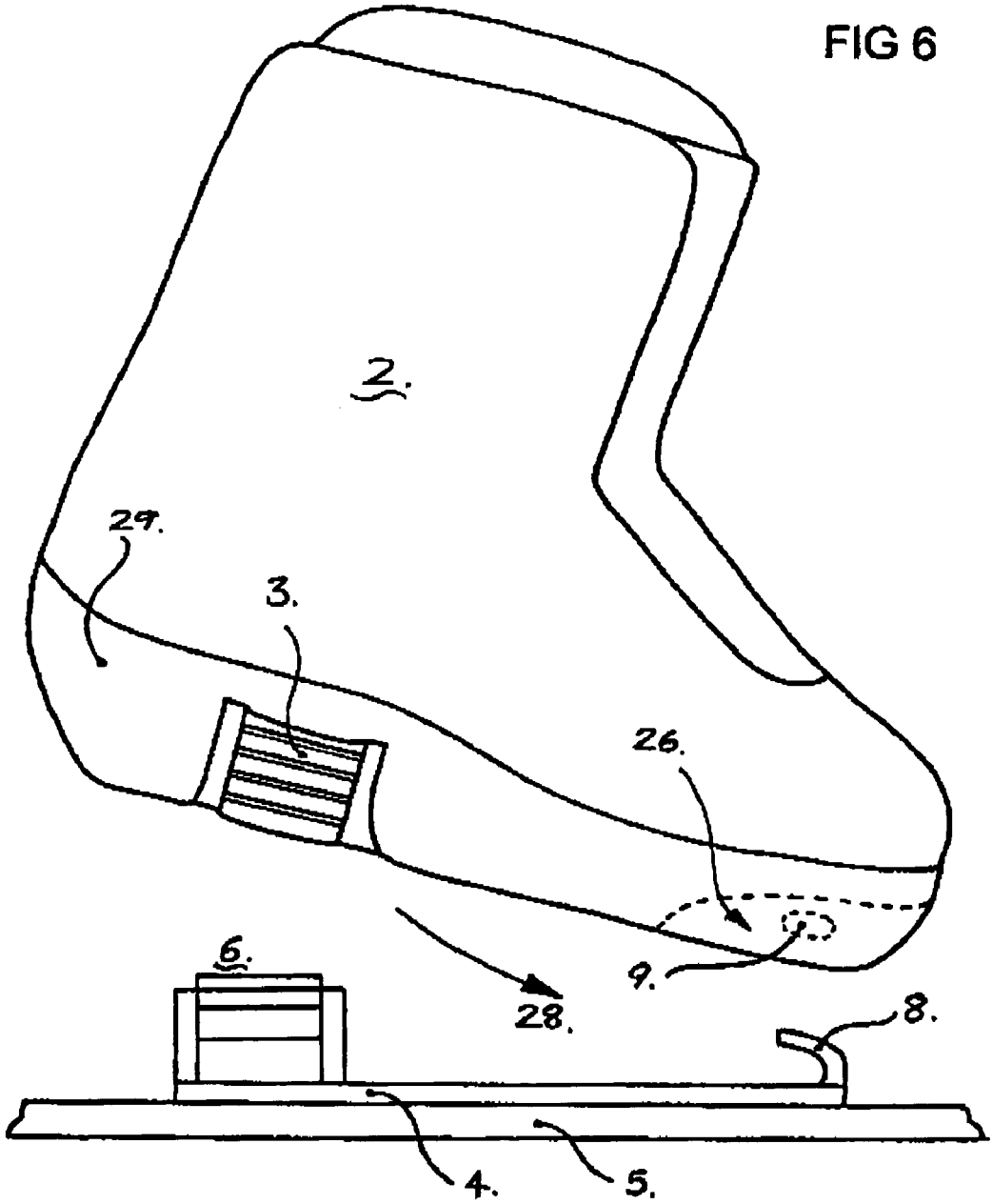
Figure 7:
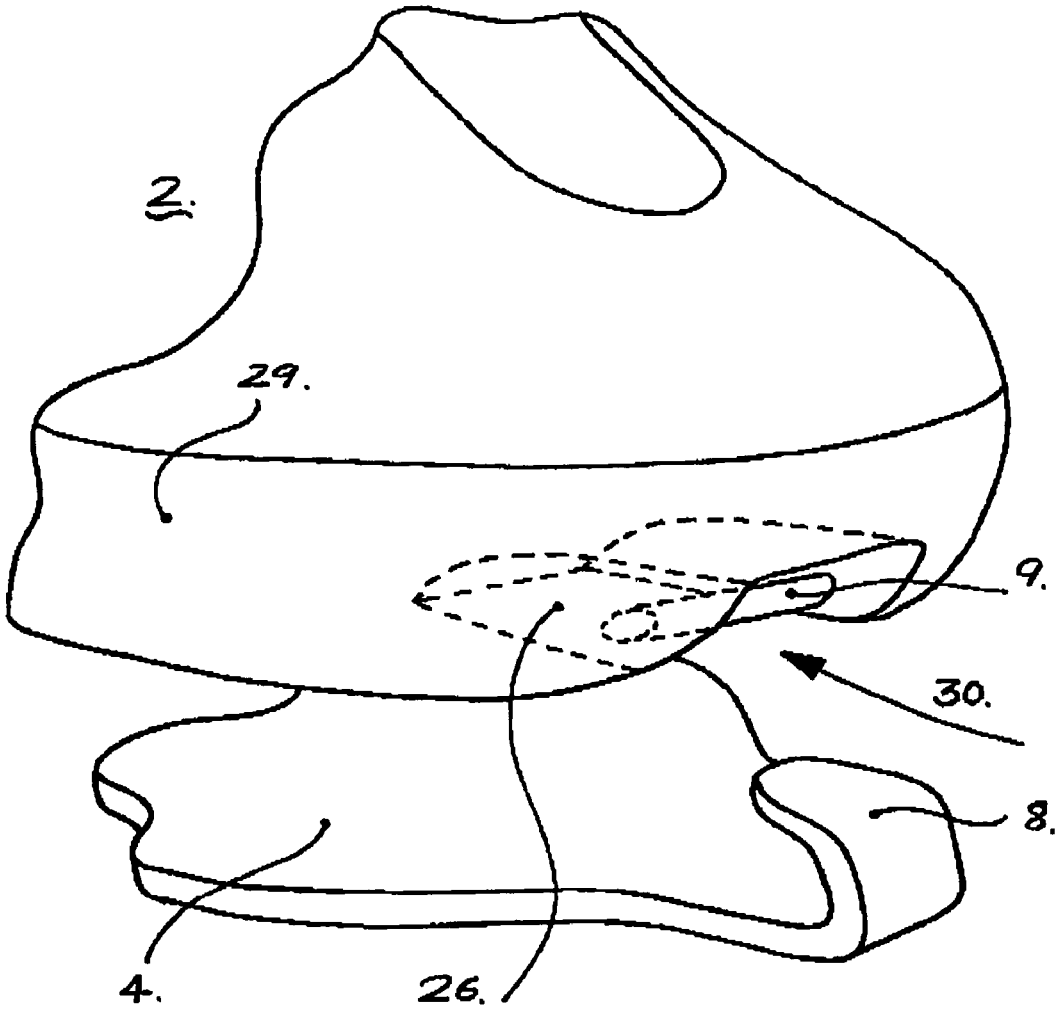
Figure 8:
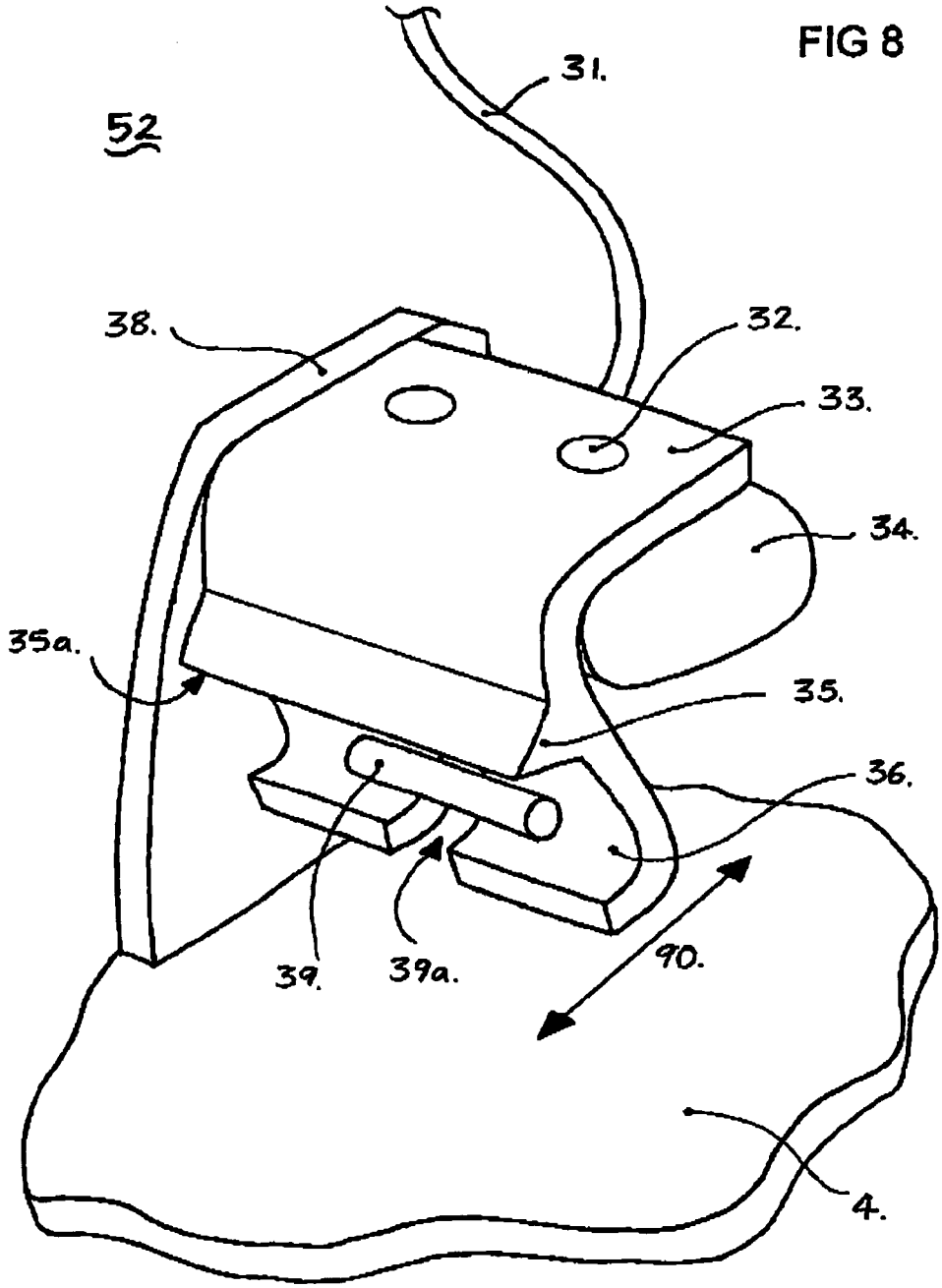
Figure 9A:
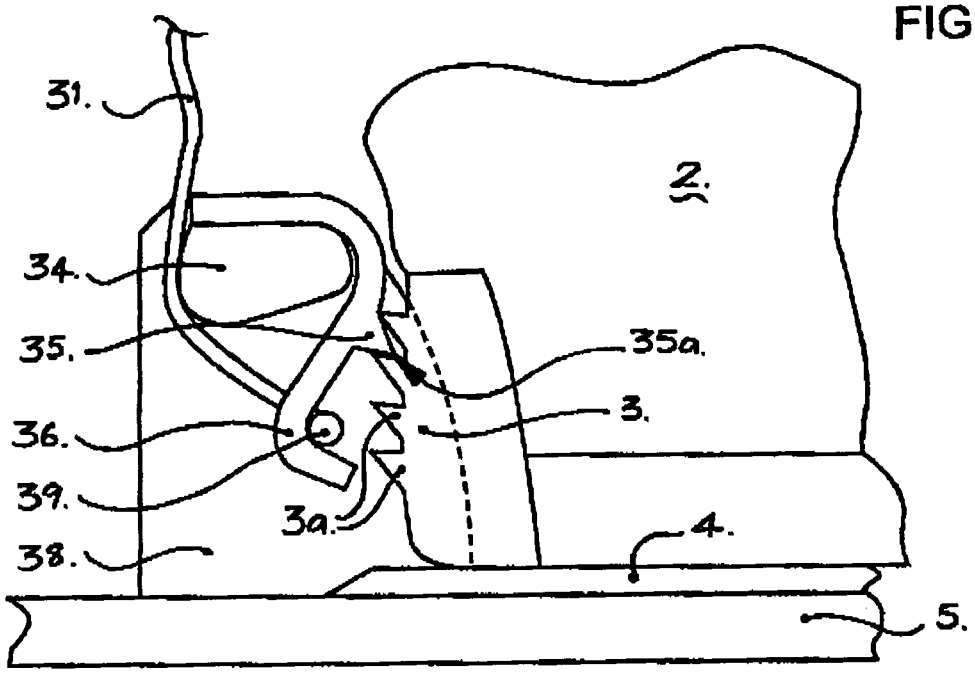
Figure 9B:
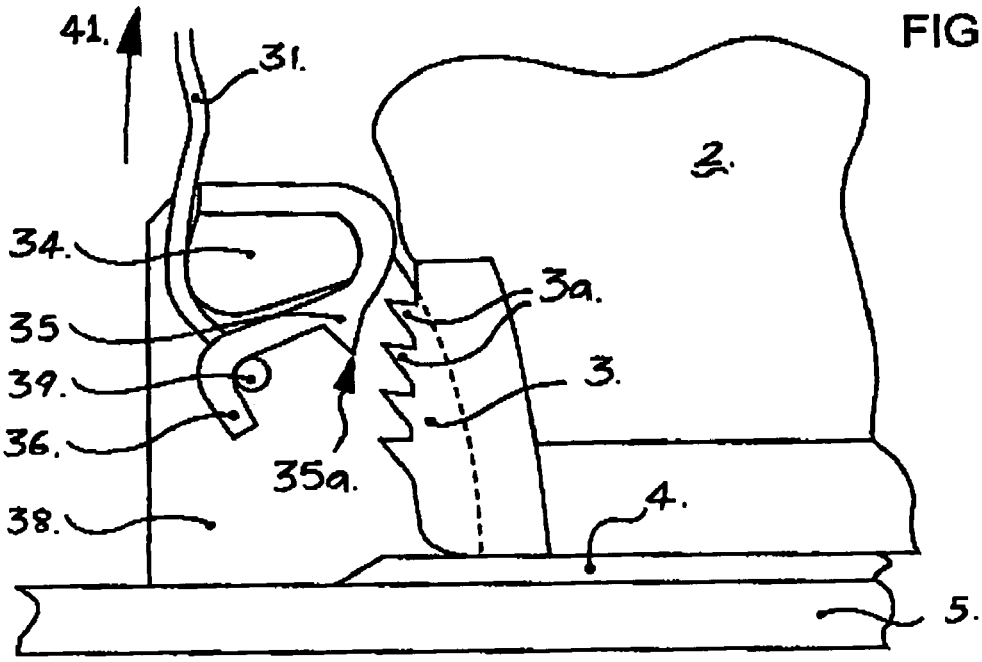
Figure 10:
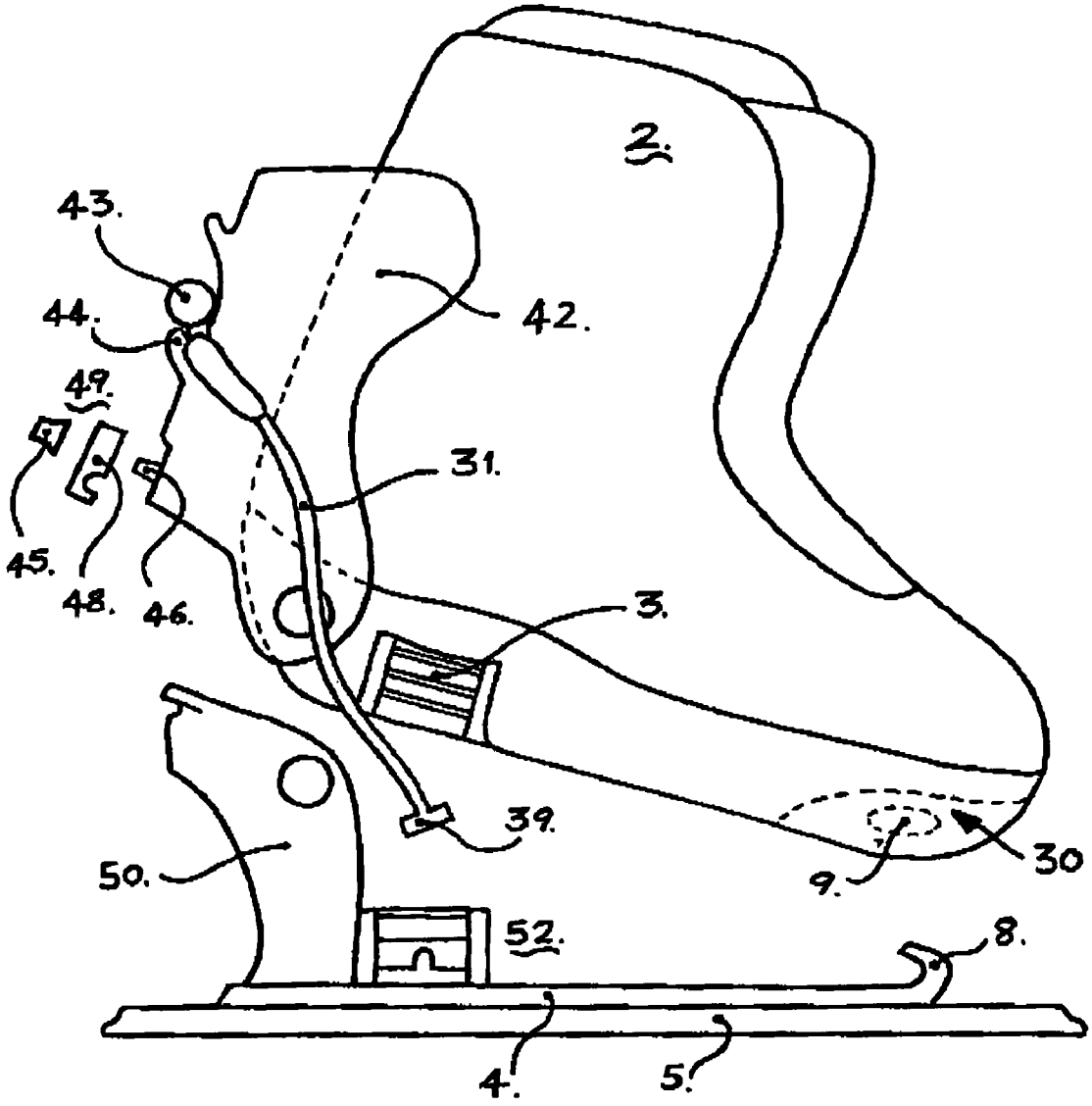
Figure 11:
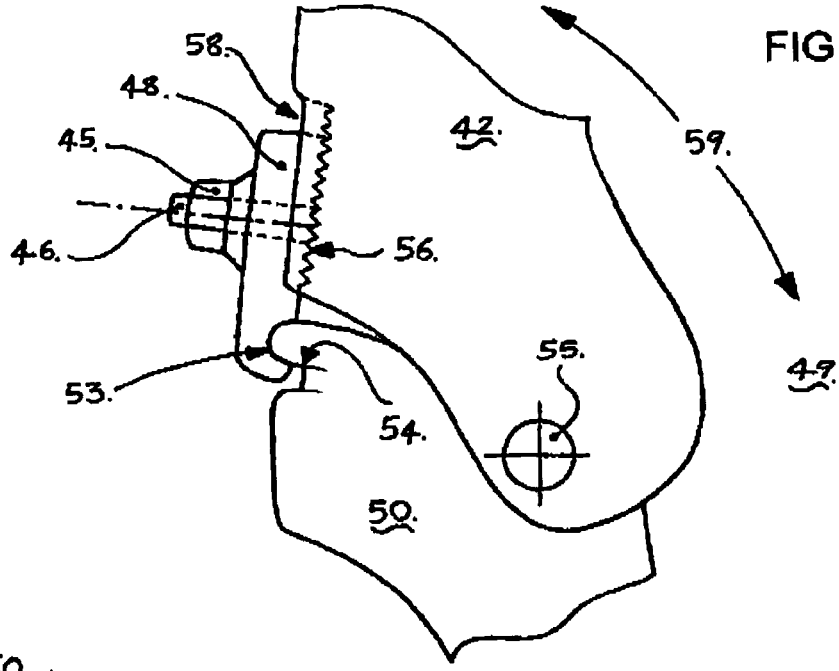
Figure 12:
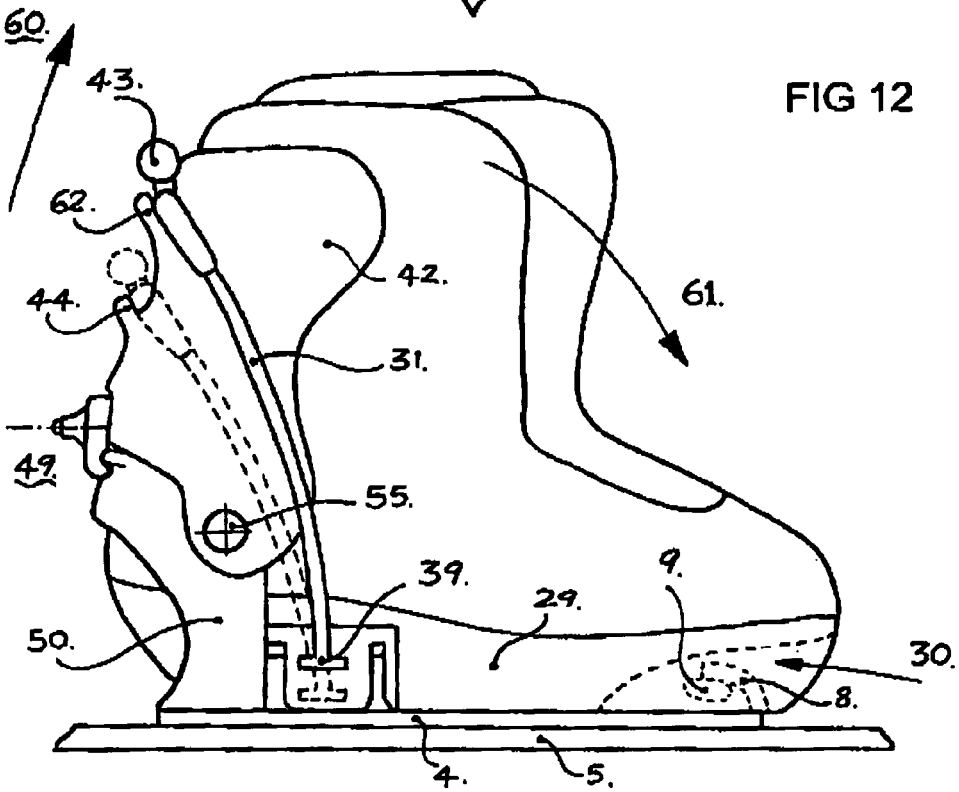
Figure 13:
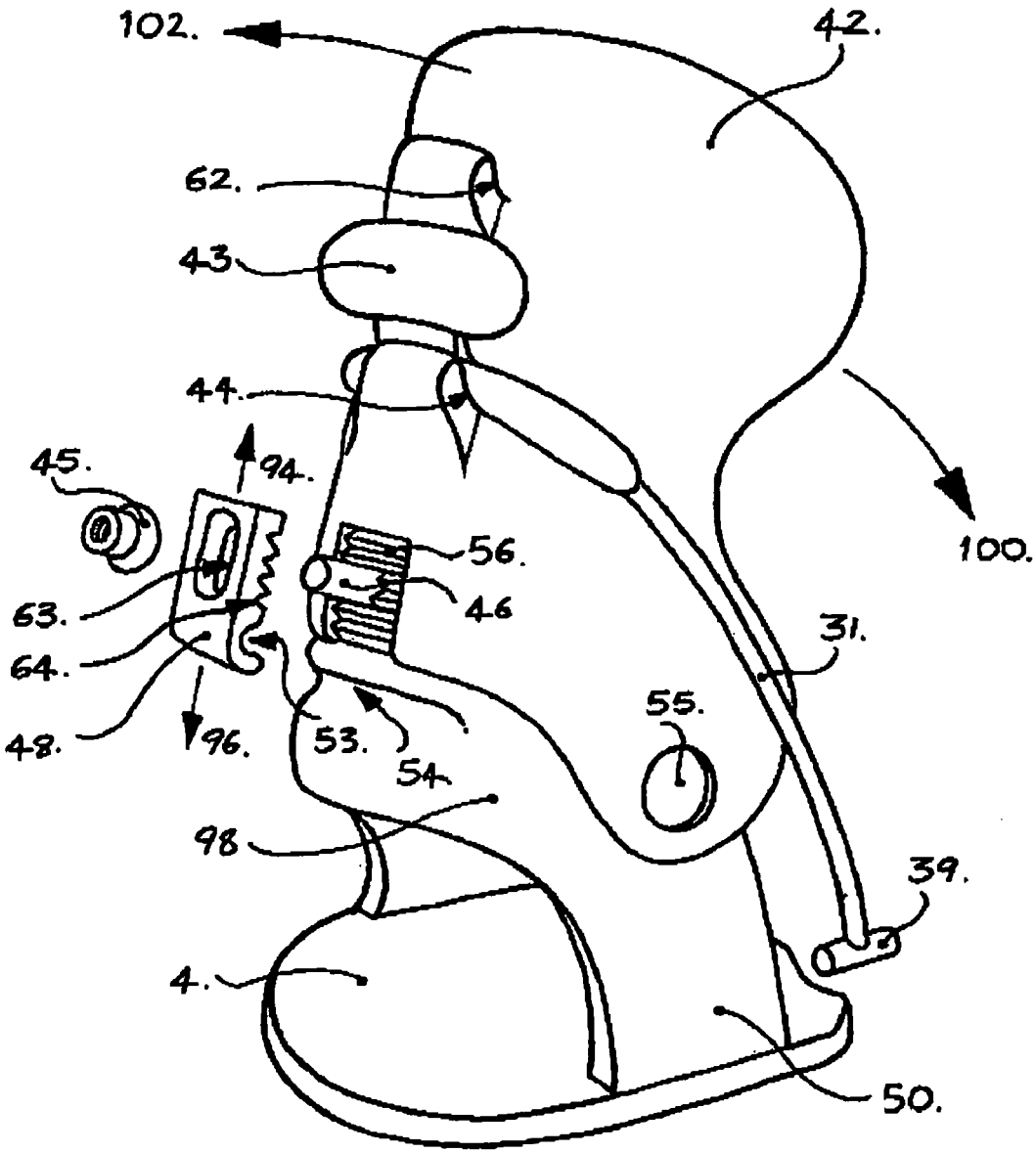
Figure 14:
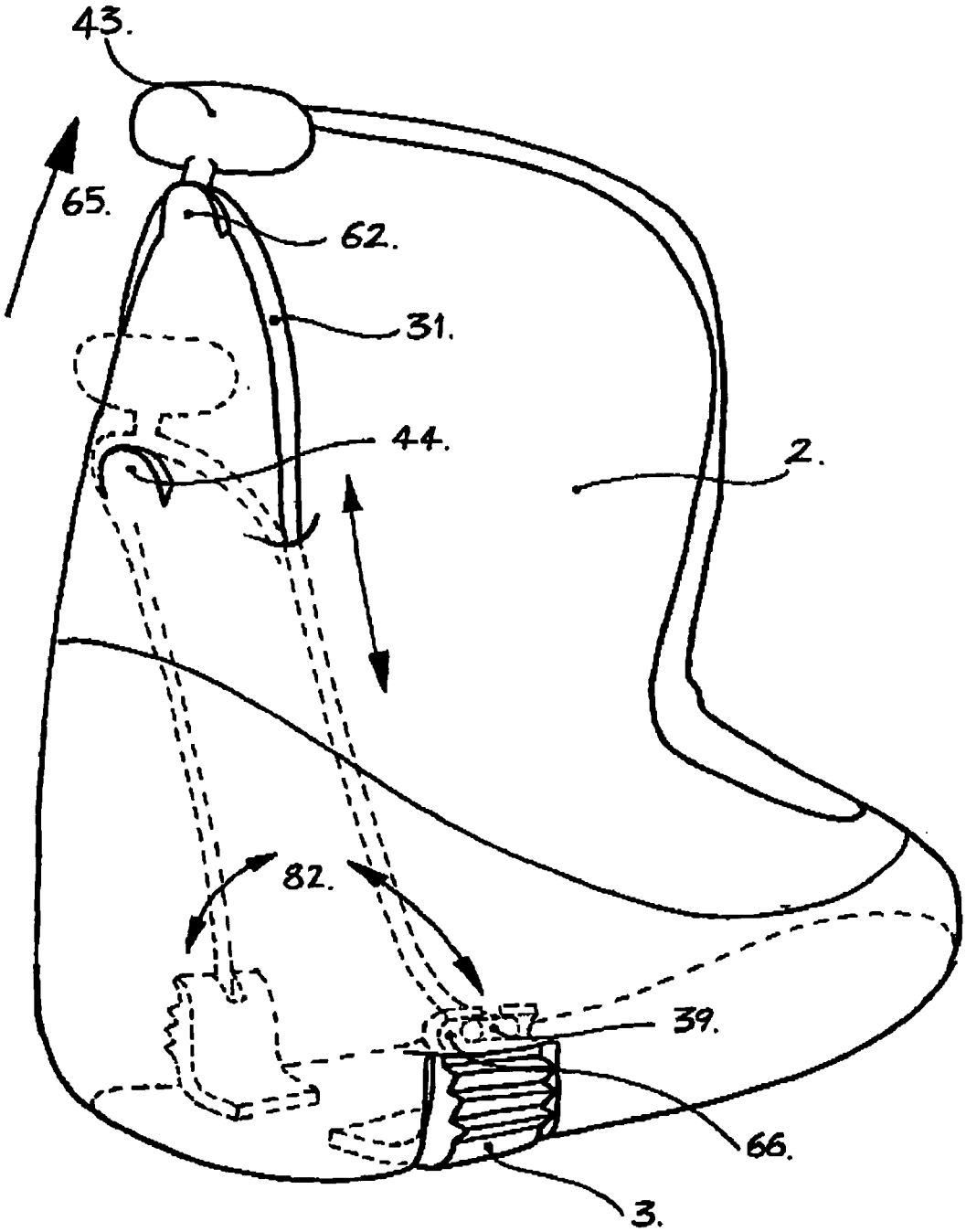
Figure 15:
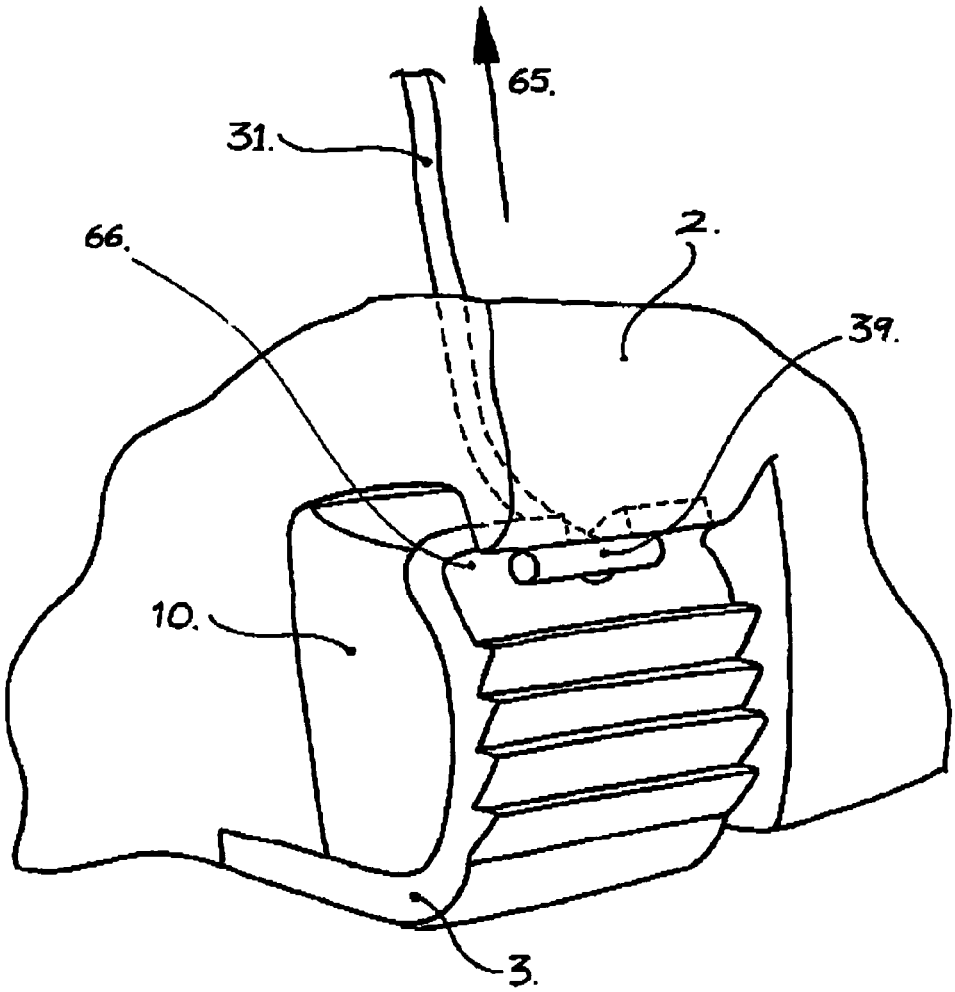

FIG. 4*a* to FIG. 4*c* are schematic end views of the binding system during the stages of engagement;

FIG. 5 is a schematic end view of the release process of the binding system;

FIG. 6 is a schematic side view of a boot coming into engagement with the binding system;

FIG. 7 is an exploded perspective view of the end of the boot as shown in FIG. 6;

FIG. 8 is an exploded perspective view of a release mechanism of a second embodiment of the binding system;

FIG. 9*a* and FIG. 9*b* are schematic end views of the release mechanism shown in FIG. 8 in use;

FIG. 10 is a schematic side view of the second embodiment of the binding system;

FIG. 11 is a schematic exploded view of an adjustment assembly of the binding system shown in FIG. 10;

FIG. 12 is a schematic side view of the binding system in use;

FIG. 13 is a perspective exploded view of the rear of the boot shown in FIGS. 10 to 12;

FIG. 14 is an exploded view of a third embodiment of the binding system; and FIG. 15 is an exploded perspective view of the embodiment shown in FIG. 14.

Figure 1:
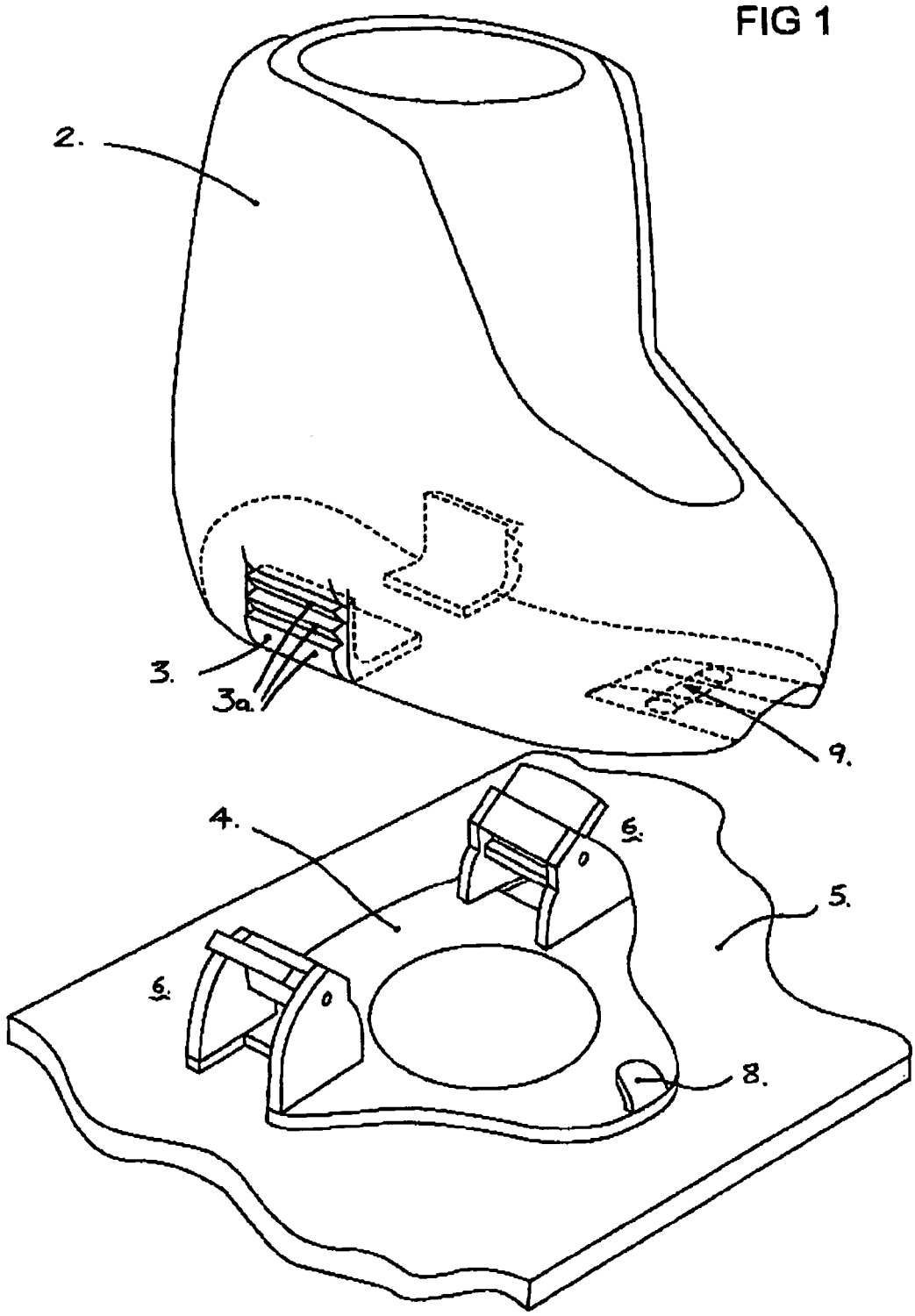
FIG. 1 is a perspective view of a first embodiment of a binding system.

Referring to FIG. 1 there is shown a boot 2 (which is worn by a snowboarder) prior to it being secured to a snowboard 5. Securing is achieved by the co-engagement of ratchets 3 present on the snowboard on each side of the boot 2 and engaging members 6 present on a binding base which is itself firmly attached to the snowboard 5.

The embodiment shown in FIG. 1 has a boot locating/securing hook 8 located towards the front of the binding base 4. In other embodiments, this locating/securing hook 8 could be located at alternative positions around the binding base 4. However, the most practical and, therefore, common locations for the boot locating/securing hook 8 are the front, rear and sides of the binding base 4. One of the benefits of this particular configuration is that it places the emphasis of support and control about the toe and heel of the rider since this is where forces are applied in order to turn or carve the snowboard 5 whilst in use. Therefore, this configuration enhances the rider's control over the board 5 and the apparent response of the board 5 during manoeuvres.

Figure 2:
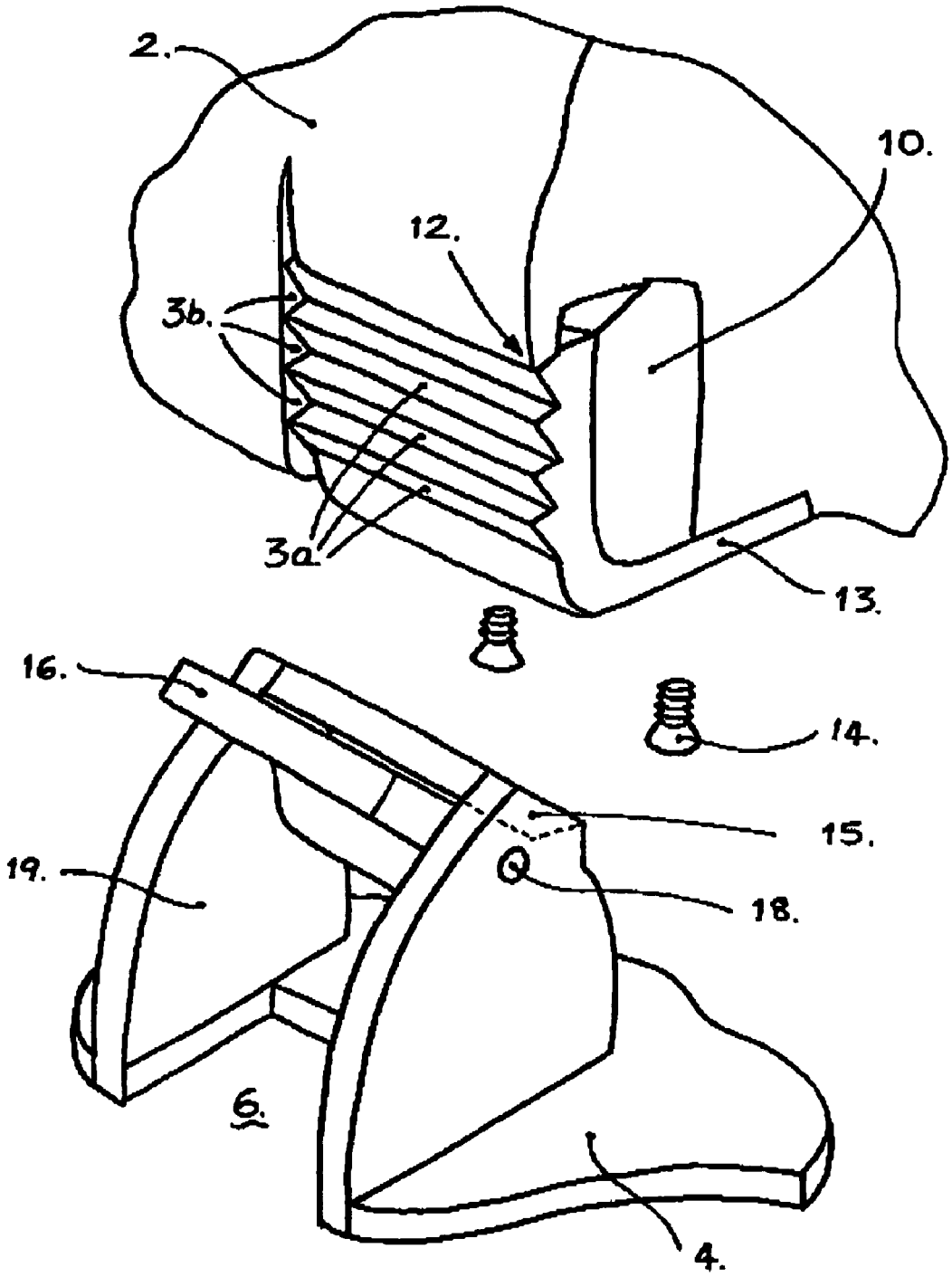
FIG. 2 is an exploded perspective view of a ratchet mechanism of the binding system as shown in FIG. 1.

Referring to FIG. 2 there is shown an exploded cutaway view of the lower part of one side of the boot 2. It illustrates the ratchet 3 being securely attached to the base of the boot 2 at point 13 by screws 14. The ratchet mechanism 3 is flexible and consists of a tough ratchet bar which has a number of horizontally-disposed, spaced-apart teeth 3*a* extending outwardly therefrom. Meshing cavities 3*b* extend between each of the teeth 3*a*. The ratchet bar and teeth 3*a* are manufactured out of plastic, metal etc. The ratchet 3 further comprises a cavity or empty space behind the ratchet bar and teeth 3*a*. The space is filled with a compressible material 10, for example, an elastomeric compound, such as, silicone.

The engaging members 6 consist of an engaging bar 15 which is attached to and extends substantially horizontally to two side panels 19 which extend substantially vertically up from the binding base 4. A release arm 16 is supported in between the side panels 19 adjacent the engaging bar 15. The release arm 16 is rotatable about a pivot 18.

Figure 3:
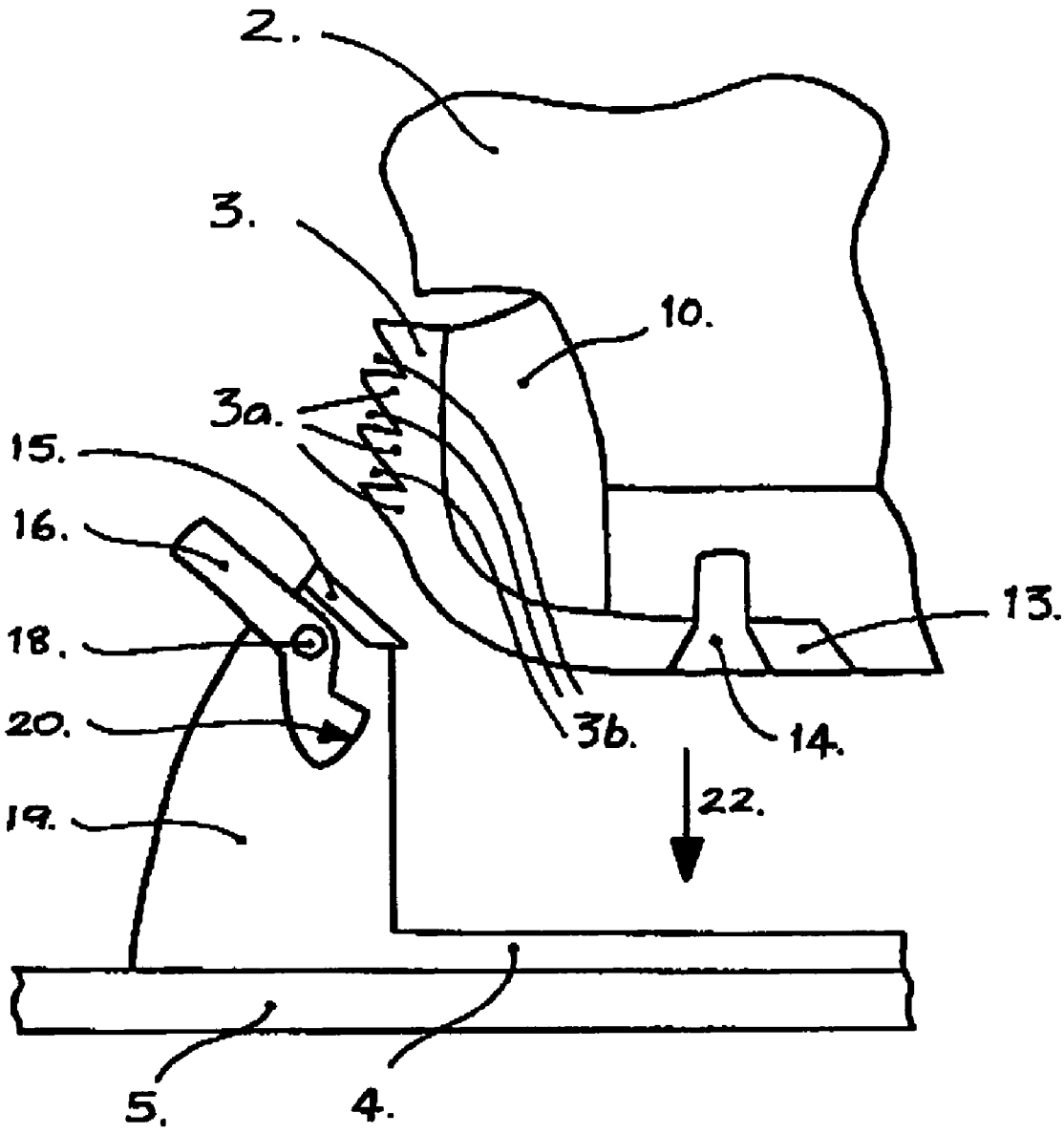
FIG. 3 is a schematic end view of the exploded view of the ratchet mechanism as shown in FIG. 2.

Referring to FIG. 3 there is shown a cross-sectional view of the lower section of the boot 2 as it comes into engagement with the binding base 4 of the snowboard 5. The general direction of movement of the boot 2 in relation to the board 5 is shown by arrow 22, i.e. downwards. It will be appreciated that disengagement of the boot 2 from the binding base 4 occurs in the opposite direction of arrow 22, ie upwards.

FIG. 3 clearly shows the relative positioning of the pivoted release arm 16 and the engaging bar 15 and how it hangs generally vertically when not in use. The lowermost end of the release arm 16 comprises a nudging edge 20.

Referring to FIGS. 4*a* to 4*c* there are shown the sequential stages of engagement between the boot 2 and the snowboard 5 binding. As the boot 2 is urged downwardly in the direction of arrow 22 towards the binding plate 4, the flexible ratchet 3, more specifically, the underside of the lowermost tooth 3*a* engages the engaging bar 15. Upon further downward movement, the ratchet 3 is flexed generally upwardly thereby deforming or compressing the elastomeric material 10 present in the cavity between the ratchet 3 and the boot 2.

The teeth 3*a* on the flexible ratchet 3 thereby pass over the engaging edge of the engaging element 15 until the boot 2 and, hence, ratchet 3 can not move any further towards the binding plate 4. At this point, the energy stored in the elastomeric material 10 causes the ratchet 3 to spring back such that the element 15 engages one of the meshing cavities 3*b* of the ratchet 3. This would normally be when the element 15 and ratchet 3 are in an engaging position such as that shown in FIG. 4*c*, ie when the base of the boot 2 has been pushed far enough down onto the snowboard 5 such that it abuts the binding plate 4. Alternatively, when obstructing material, for example, snow, ice, dirt 100 etc becomes lodged in the space between the base of the boot 5 and the binding plate 4, the engaging element 15 will engage the flexible ratchet 3 at a height pre-determined by the amount of obstructing material 100.

Referring to FIG. 5, there is shown a close up view of the ratchet mechanism 3 illustrating the activation of the release lever 16 and the release process of the boot 2 from the snowboard 5 binding. In order to release the boot 2 from the binding and, hence, cause the disengagement of the engaging bar 15 from the flexible ratchet 3, the release lever 16 is pressed generally in the direction as shown by arrow 23, ie downwardly. This movement causes the nudging edge 20 of the release lever 16 to rotate about pivot 18 and generally in an upwardly direction thereby engaging the teeth 3*a* of the flexible ratchet 3. In doing so, the flexible ratchet 3 is forced in the direction shown by arrow 24 thereby compressing the elastomeric material 10. The rotational movement of the release lever 16 also acts to assist the ejection of the boot 2 upwardly and out of the binding in the direction generally shown by arrow 25. Thus, it will be seen that the release lever 16 serves the dual purpose of disengaging the engaging element 15 from the flexible ratchet 3 and concomitantly urging the boot 2 upwardly and out of the snowboard binding.

Referring to FIGS. 6 and 7, there are shown the mechanism by which the boot 2 is located and secured onto the binding base 4. FIG. 7 shows the toe section of the boot 2 having a cavity 26 and a bar 9 which extends transversely across the cavity 26. As the boot 2 is positioned to engage the binding, the bar 9 is first hooked underneath the securing hook 8 (in the direction of arrow 30). As the boot travels in the direction as shown by arrow 28, the hook 8 fits around the bar 9 and forces any obstructions, for example, ice, snow, dirt etc. towards the cavity 26.

Referring to FIG. 8, there is shown an alternative embodiment for the release process of the boot 2 from the binding. This is used instead of the release lever 16 shown in FIGS. 1 to 6. In this embodiment, an assembly generally as shown as 52 has side wall supports 38 which are attached to, and extend generally vertically from the binding base 4. A flexible engaging head element 33 is attached to a fixed solid bale 34 which extends generally horizontally across from the side wall supports 38 by means of fixings 32, for example, screws. It is possible to remove the head element 33 from the solid bale 34 such that both may be cleaned and/or replaced, for example, with an element 33 having an alternative stiffness. For example, this would be useful to suit the particular weight of different riders. It would be possible to purchase the flexible engaging head element 33 as part of a kit.

Extending transversely from the head element 33 is an engaging protrusion 35 which tapers substantially to a narrow engaging tip 35*a*. The tip 35*a* is shaped to fit in between the teeth 3*a* of the ratchet mechanism 3, ie the meshing cavities 3*b*. Extending in the head element 33 transverse to the axis of the protrusion 35, is an elongate slot 39*a*.

In use, the flexible engaging head 35 may be made to flex back and forth in the direction of arrow 90 under the tension of a cable 31. This is attached indirectly to the flexible head 33 via a cable anchor 39 which passes through the slot 39*a* and which sits in a curved section 36 of the head element 33. The cable 31 allows the rider to pull on and flex the head element 33 backwards and, hence, disengage the engaging protrusion 35 from the ratchet 3.

Referring to FIGS. 9*a* and 9*b*, there is shown the operation of the alternative embodiment of the release mechanism of the snowboard binding. FIG. 9*a* shows the engaging protrusion 35 of the flexible head 33 engaging the ratchet 3 thereby binding the boot 2 in position on the binding plate 4. The cable 31 is pulled by the rider generally upwardly in the direction as shown by arrow 41 (FIG. 9*b*) which thereby causes the cable anchor 39 to flex the engaging head 33 back around the fixed solid bale 34. This results in the engaging head 35 being pulled away and disengaged from the ratchet 3 thereby allowing the boot 2 to be removed upwardly and away from the binding plate 4. Once the boot 2 has been removed from the binding, the rider releases the cable 31 and thereby allows the engaging head element 33 to flex back to its original position.

Referring to FIG. 10, there is shown how the cable-pull arrangement 31 is incorporated into a high heel back 42 of the boot 2. The flexible heel 33 and cable 31 are connected to a pull handle 43 which may be maintained on the high back 42 at different heights of securing lips 44, 62, as desired. This arrangement is suited for use in deep snow and generally easy access of the release mechanism by the rider.

As can be seen in FIGS. 10 and 12, the pull handle 43 initially sits in the securing lip 44 of the high heel back 42. Pulling the handle 43 upwardly in the direction of arrow 60 creates tension in the cable 31, which causes the cable line anchor 39 to lift the curved section 36 of the flexible head 33 upwardly. This results in the engaging protrusion 35 disengaging from the ratchet 3 allowing the boot 2 to be lifted out of the binding.

Referring to FIG. 12, the open position of the binding can be maintained by securing the pull handle 43 to sit on the upper securing lip 62 of the heel back 42. In this position, the tension in the cable 31 would normally cause the heel back 42 to undesirably rotate forwardly about a pivot 55 located at the base of the high back 42 screw in direction 61. However, this is prevented by a rear heel lean adjusting assembly 49 which consists of a threaded screw 46, an adjusting member 48, a tightening nut 45 and a lower ankle support structure 50. The adjustment of assembly 49 sets the amount of lean of the heel back 42 relative to the lower binding base 4. This allows the rider to adopt a variety of leaning positions on the snowboard 5 for various levels of board edge control whilst in use.

FIGS. 11 and 13 show a close up of the heel lean back adjusting assembly and how the heel back threaded screw 46 fits through the slot 63 of the adjusting member 48. This in turn is held in place by the tightening nut 45 situated in a recess 56 of the heel back 42. Slot 63 allows the adjusting member 48 to be adjusted in either upward (arrow 94) or downward (arrow 96) directions.

In order to prevent the adjusting assembly 49 from slipping/sliding upwards or downwards along the heel back 42, a series of horizontal grooves 64 situated on the back face of the adjusting member 48 mate with an opposing series of grooves 56 situated on the base surface of the heel back recess 56. A hook 53 is provided at the base of the adjusting member 48 which is hooked onto a curved recess 54 of a lower ankle support 98 thereby securing the heel back 42 against rotations in either directions shown by arrows 100 or 102 about the heel pivot screw 55.

Referring to FIG. 14, there is shown a third embodiment of the snow boot/board binding arrangement illustrating how the cable 31 is routed actually through the boot 2 and attached directly to the flexible ratchet element 3. This is achieved by hooking the cable anchor 39 around a curved section 66 present at the upper face of each ratchet element 3 on either side of the boot 2. As the cable 31 is pulled in the direction of arrow 65, the flexible ratchet 3 is pulled upwardly and inwardly towards the direction of the boot as shown by arrows 82 thereby compressing the elastomeric material 10. This results in the disengagement of the flexible ratchet element 3 from the engaging bar 15 (see FIG. 3). The figure shows the hidden cable 31 and handle 43 as a dashed line when on the lower securing lip 44 and as a filled line when on the upper securing lip 62.

Referring to FIG. 15, there is shown an overall view of the cable 31 incorporated actually into the boot 2.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extend to any novel one, or any novel combination, of the features disclosed in this specification (including any accompanying claims, abstract and drawings), or to any novel one, or any novel combination, of the steps of any method or process so disclosed.

The invention claimed is:

1. A binding system for a snowboard comprising a boot and a boot receiving plate, the boot receiving plate having first and second engagement elements, and the boot having first and second boot gripping elements wherein, the first boot gripping element and the first engagement element are mutually arranged to provide at least two binding gripping positions at different boot heights above the boot receiving plate and are operable for flexible respective co-engagement, the second boot gripping element and the second engagement element are mutually arranged to provide at least two binding gripping positions at different boot heights above the boot receiving plate and are operable for flexible respective co-engagement, wherein at least one of the first and second engagement elements has a flexible surface that deflects to engage the respective boot gripping element, and/or at least one of the first and second boot gripping elements has a flexible surface that deflects to engage the respective engagement element.

2. A binding system according to claim 1, wherein the first and second boot gripping elements are located on either side of the boot.

3. A binding system according to claim 1, further comprising means for providing at least two binding gripping positions above the boot receiving plate comprising ratchet means operable to provide the binding between the respective boot gripping element and the engagement element.

4. A binding system according to claim 3, wherein the ratchet means comprise an engagement member and a rack, the rack comprising a plurality of teeth with spaces therebetween, each space providing an engagement member receiving position.

5. A binding system according to claim 4, wherein the rack and engagement member are designed so that their respective surfaces are operable to slide over each other in a first direction and operable to lock in a direction opposite to the first direction.

6. A binding system according to claim 4, wherein the outer surface of the boot gripping element comprises the rack which is attached to or is integral with the boot.

7. A binding system according to claim 4, wherein the engagement member is attached to or is integral with the boot receiving plate.

8. A binding system according to claim 4, wherein the rack extends away from the boot substantially towards and perpendicular to the boot receiving plate.

9. A binding system according to claim 4, wherein the teeth of the rack extend substantially parallel with the boot receiving plate.

10. A binding system according to claim 4, wherein the engagement element comprises the engagement member which is supported substantially parallel with the boot receiving plate in between two supports, which supports extend substantially away from and perpendicular to the boot receiving plate.

11. A binding system according to claim 10, wherein the engagement member extends substantially inwardly from the supports and generally in a direction towards the rack.

12. A binding system according to claim 1, wherein the or each engagement element are flexible.

13. A binding system according to claim 1, wherein the or each boot gripping element are flexible.

14. A binding system according to claim 4, wherein the outer surface of the boot gripping element comprises the rack.

15. A binding system according to claim 4, wherein the rack comprises a rigid material which is secured to the underside of the boot by suitable means.

16. A binding system according to claim 4, wherein the boot gripping element comprises a cavity substantially behind the rack.

17. A binding system according to claim 1, wherein the binding system comprises at least one binding release mechanism.

18. A method of binding a boot to a boot receiving plate, the method comprising the steps of:

(i) providing a binding system according to claim 1;

(ii) locating the boot such that the or each boot gripping element is engaged by the or each corresponding engagement element; and (iii) pressing the boot down toward the boot receiving plate until the or each boot engagement element locks in position with the or each boot gripping element, wherein multiple locking positions are provided during the said downward movement at different heights above the boot receiving plate.

19. A binding system for a snowboard comprising a boot and a boot receiving plate, the boot receiving plate having first and second engagement elements, and the boot having first and second boot gripping elements wherein, the first boot gripping element and the first engagement element are mutually arranged to provide at least two binding gripping positions at different boot heights above the boot receiving plate and are operable for flexible respective co-engagement, the second boot gripping element and the second engagement element are mutually arranged to provide at least two binding gripping positions at different boot heights above the boot receiving plate and are operable for flexible respective co-engagement, wherein at least one of the first and second engagement elements has a flexible surface that deflects to engage the respective boot gripping element, and the flexible surface contacts the respective boot gripping element during engagement.

20. A binding system for a snowboard comprising a boot and a boot receiving plate, the boot receiving plate having first and second engagement elements, and the boot having first and second boot gripping elements wherein, the first boot gripping element and the first engagement element are mutually arranged to provide at least two binding gripping positions at different boot heights above the boot receiving plate and are operable for flexible respective co-engagement, the second boot gripping element and the second engagement element are mutually arranged to provide at least two binding gripping positions at different boot heights above the boot receiving plate and are operable for flexible respective co-engagement, wherein at least one of the first and second boot gripping elements has a flexible surface that deflects to engage the respective engagement element, and the flexible surface contacts the respective engagement element during engagement.

21. The binding system according to claim 20, further comprising:

a first cavity located between the first boot gripping element and the boot;

a second cavity located between the second boot gripping element and the boot; and an elastomeric element occupying at least one of the first and second cavity.

* * * * *